US006771159B2

(12) United States Patent
Ramahi et al.

(10) Patent No.: US 6,771,159 B2
(45) Date of Patent: Aug. 3, 2004

(54) CONTACT SPRING FOR MINIATURE THERMOSTAT

(75) Inventors: Majdi Ramahi, New Market, MD (US); David Fisher, Martinsburg, WV (US)

(73) Assignee: Airpax Corporation L.L.C., Frederick, MD (US)

( * ) Notice: Subject to any disclaimer, the term of this patent is extended or adjusted under 35 U.S.C. 154(b) by 0 days.

(21) Appl. No.: 10/289,503

(22) Filed: Nov. 6, 2002

(65) Prior Publication Data

US 2003/0085791 A1 May 8, 2003

Related U.S. Application Data

(60) Provisional application No. 60/337,293, filed on Nov. 8, 2001.

(51) Int. Cl.[7] ..... H01H 37/52; H01H 37/54

(52) U.S. Cl. ..... 337/379; 337/112; 337/380; 29/622

(58) Field of Search ..... 337/36, 52, 53, 337/97, 112, 113, 333, 342, 343, 379, 380; 29/622

(56) References Cited

U.S. PATENT DOCUMENTS 4,400,679 A * 8/1983 Snider ..... 337/382
4,620,175 A 10/1986 Karr et al.
4,795,997 A 1/1989 Fisher et al.
5,182,538 A * 1/1993 Muller ..... 337/102
5,607,610 A * 3/1997 Furukawa ..... 219/505
5,804,798 A * 9/1998 Takeda ..... 219/511
5,936,510 A * 8/1999 Wehl et al. ..... 337/377
6,281,780 B1 * 8/2001 Sugiyama et al. ..... 337/137
6,335,113 B1 * 1/2002 Nakatani et al. ..... 429/90
6,396,381 B1 * 5/2002 Takeda ..... 337/377

* cited by examiner

*Primary Examiner*—Anatoly Vortman
(74) *Attorney, Agent, or Firm*—Milde & Hoffberg LLP

(57) ABSTRACT

A switch comprising a molded housing having a cavity, and a set of electrical terminals formed within said cavity, with a displaceable elongated contact arm selectively forming a circuit between said set of terminals, wherein said displaceable elongated contact arm comprises a base having a formed edge which mates with said molded housing inside said cavity, to align said displaceable elongated contact arm with respect to said set of terminals. A method for forming a switch, comprising the steps of providing a molded housing having interior sidewalls defining a cavity, and a set of electrical terminals formed within the cavity; inserting a displaceable elongated contact arm within the cavity, the displaceable elongated contact arm having a base with formed edges which mate with the sidewalls, to align the displaceable elongated contact arm with respect to the set of terminals.

20 Claims, 5 Drawing Sheets

CONTACT SPRING FOR MINIATURE THERMOSTAT

This application claims the benefit of provisional application Ser. No. 60/337,293 filed Nov. 8, 2001.

FIELD OF THE INVENTION

The present invention relates to a miniature switch having a self-aligning displaceable elongated contact arm. Preferably, the switch is a thermostat.

BACKGROUND OF THE INVENTION

A DIP (dual in-line package) is an electronic component available in several standard sizes and includes a housing having downward extending terminal pins which are received in plated through holes of a PCB. The chip or the like in the housing is thus connected to circuitry and other components.

U.S. Pat. No. 4,620,175, which is incorporated herein by reference, discloses a simple thermostat configured as a standard DIP (dual inline pin, 0.4" wide, with pins on 0.1" centers) having four terminal pins. Since the package is virtually identical to a standard DIP, it does not require any special hole spacing by the PCB manufacturers or any special assembly equipment. The terminal pins come in two pairs, the pins in each pair being connected through a single inward end inside the housing so as to be electrically redundant.

The housing for the thermostat of U.S. Pat. No. 4,620,175 includes a floor, opposed parallel sidewalls, and opposed parallel endwalls, that define a cavity therebetween. The housing is molded onto first and second terminals, discussed above, so that the inward ends are exposed at opposite ends of the floor and the pins extend downward therefrom through the housing. A contact arm is fixed to the inward end of the first terminal and has a cantilever arm whose free end has a contact fixed thereto and is biased away from but movable toward a fixed contact on the inward end of the second terminal. A fulcrum plate having a central dimple is fixed between the sidewalls and a bimetal strip is located between the fulcrum plate and the contact arm. The bimetal strip has two stable positions, and is thus considered to be bistable; in a first stable position the strip is bowed convexly against the dimple and biases the contact on the contact arm against the contact on the second terminal, to complete the circuit between the first and second terminals. In the second stable position, which occurs when the bimetal strip rises above a predetermined temperature, the bimetal strip is bowed concavely toward the dimple so that the contact arm springs away from the second terminal to open the circuit. The foregoing describes an "open on rise" thermostat; a "close on rise" device can be provided simply by inverting the bimetal strip.

The DIP thermostat of U.S. Pat. No. 4,620,175 is intended for mounting in a region having an airflow sufficient to activate the switch through conduction of heat to and from the ambient air.

A board mounted thermostat is disclosed in U.S. Pat. No. 4,795,997, expressly incorporated herein by reference, is virtually identical to a TO-220 package as depicted in FIG. 1. This package has but two pin terminals and further has a mounting bracket fixed thereto. The terminals are flat stamped pieces to which the housing is molded. The thermostat described in U.S. Pat. No. 4,795,997, includes a cover plate incorporating the mounting bracket fixed over the cavity, which provides means for efficient heat transfer to the thermostat, to assure timely operation and thus protect the system. Thus, while a standard TO-220 electronic package uses the mounting bracket to dissipate heat from a semiconductor chip or resistor, the thermostat design uses the bracket to conduct heat between a nearby surface to the thermostat, so that the thermostat senses the temperature of the surface.

One problem with the design according to U.S. Pat. No. 4,795,997 is that, during volume production, there are a relatively high number of reject thermostat assemblies, resulting from contact spring misalignment.

SUMMARY AND OBJECTS OF THE INVENTION

It is an object of the present invention to improve miniature thermostat designs, by providing a switch contact arm having a self-aligning feature with respect to a switch housing. This feature preferably results in a good production yield.

It is also an object according to the present invention to provide a contact arm having a base and an extension, wherein the base comprises a form fit or force fit configuration for aligning the extension with respect to a base mounting space.

The present invention preferably provides improved quality, such as by limiting rejected parts due to a spring misalignment failure mode.

The present invention provides a thermostatic switch for mounting to a circuit board, having a housing configured with a cavity, with first and second terminals formed within the cavity, one of the terminals being displaceable with respect to the other, selectively forming a conducting path between the two terminals. The displaceable terminal is configured as an elongated cantilever arm, extending from a base. The base is form or force fit into the cavity and aligned by boundary walls thereof, causing the displaceable elongated cantilever arm to be aligned with the other terminal. The base preferably comprises a pair of bent tabs which contact opposite lateral sidewalls of the cavity.

These and other objects will become apparent from a review of the detailed description of the preferred embodiments of the invention.

DETAILED DESCRIPTION OF THE PREFERRED EMBODIMENT

In manufacturing of the thermostatic switch according to the prior art, there was reported a relatively high reject ratio at the spring assembly process, and further concerns relating to potential misassembled parts that might escape detection. Further, the production methods associated with the prior art did not accommodate a self-alignment feature or otherwise reasonably provide for a reduction in misaligned contact arms.

Accordingly, the present invention provides a modification with respect to prior art contact arms, and in particular the spring tab, to provide a pair of formed angles on opposing lateral sides on the back (welded portion) of the spring. A preferred embodiment provides a spring contact arm for a switch wherein the edges of the spring pad are formed, hence controlling the clearance of the assembled switch, and further providing a lead in to the base cavity and self orienting and aligning properties.

It was found that, with adjustment of the basic manufacturing process for the switch to account for the different dimensionality and shape of the revised contact spring design, that the rejection of product for misalignment of the contact spring during a pilot run was substantially reduced from that observed in the prior art manufacturing process.

Comparative Example (U.S. Pat. No. 4,795,997)

Figure 1:
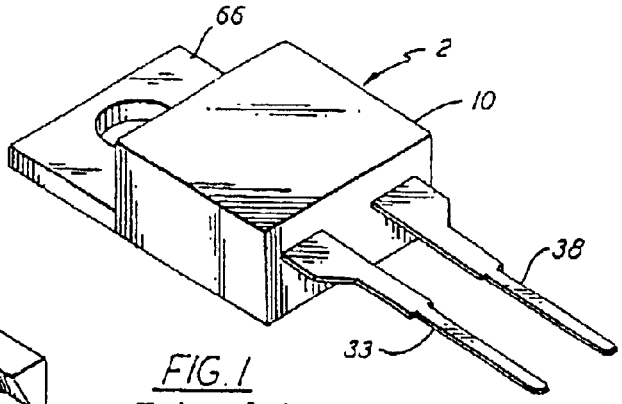
FIG. 1 Prior Art
FIG. 1 is a perspective of a TO-220 package according to the prior art.

FIG. 1 depicts a standard TO-220 electronic package 2, which includes a dielectric housing 10, pin terminals 33 and 38, and a mounting bracket 66 which serves as a heat sink. A single pole, single throw snap action thermostat occupies the identical package, and is shown exploded in FIG. 2. The dielectric housing 10 is molded onto terminals 30, 35 in a straight draw to form a boxlike structure having a cavity bounded by floor 12, sidewalls 16, and endwalls 22. The preferred material is a high temperature plastic such as Ryton R-10. The terminals 30, 35 have respective inner portions 31, 36 (shown in FIG. 3) which are inset in floor 12 so as to be flush therewith. The floor 12 is surrounded by a peripheral platform 14 from which locating portions 28 having ribs 29 extend over the inner portion 31. Sidewalls 14 have two pairs of opposing tongues 18 extending toward each other while endwalls 22 have one pair of opposed tongues 24. All tongues stand proud of platform 14 and have stepped ends 20 whose function will be described below.

Figure 2:
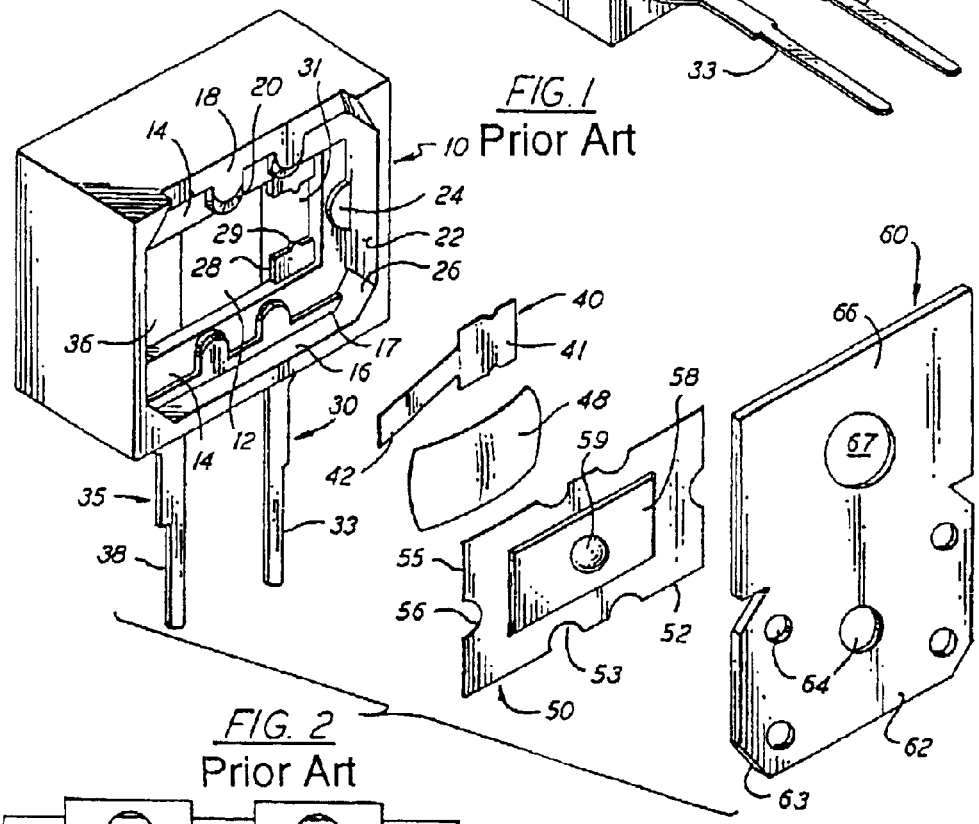
FIG. 2 Prior Art
FIG. 2 is an exploded perspective of the thermostat according to the prior art.

Referring still to FIG. 2, the contact arm 40 is stamped and formed from spring metal with a first end or base 41 that is notched for reception between ribs 29 and a second or free end 42. During assembly the first end 41 is resistance welded to inner portion 31 so that second end 42 is biased away from inner portion 36. Bimetal strip 48 is a conventional dished element that flips at a predetermined temperature, typically from 40° to 150° C. During assembly the strip 48 is placed in the cavity against arm 40 so that it is free and unrestrained on all sides. The fulcrum plate 50 is then placed against platform 14 to capture the element 48. The fulcrum plate is stamped from aluminum with side edges 52 having scallops 53 for reception about tongues 18, and end edge 55 having scallops 56 for reception about tongues 24. The plate 50 is also formed with a raised portion 58 having dimple 59 which extends into the cavity. After emplacing the arm 40, and element 48, fulcrum plate 50 is retained against platform 14 by heat staking the tongues 18, 24. This is accomplished by applying heat and pressure to the stepped portions 20; the steps 20 ensure that any displaced plastic will not extend above the highest profile of the tongues. An epoxy is then applied to the top of the fulcrum plate 50 and the mounting plate 60 is emplaced, whereafter the assembly is baked to cure the epoxy. The plate 60 is a nickel plated copper piece having a cover portion 62 with beveled corners 63 profiled to fit against beveled corners 26 in the housing 10. Holes 64 take up excess epoxy. The plate 60 also includes a bracket 66 having a central hole 67 for receiving screw means.

Figure 3:
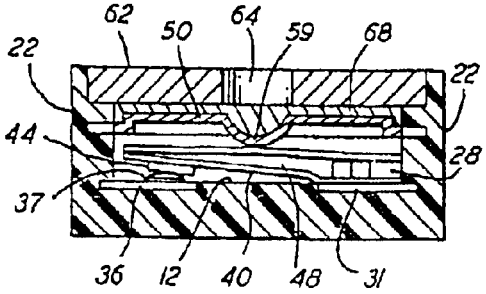
FIG. 3 Prior Art
FIG. 3 is a section view of the assembled thermostat according to the prior art.

FIG. 3 shows the cooperation of the parts in greater detail. The inner portion 36 of second terminal 35 has a gold plated contact 37 fixed thereto by resistance welding, while the free end of contact arm 40 has a contact 44 fixed thereto. The bimetallic element 48 is shown bowed convexly toward the dimple or fulcrum point 59 so that circuit between terminals 30, 35 is closed. When the characteristic temperature is reached, the element "snaps" to an oppositely bowed configuration so that the circuit opens. A "close on rise" device can be provided simply by inverting the bimetallic strip. The epoxy 68, in addition to providing a sealing and retaining function, reinforces the dimple 59 so that proper calibration is maintained and further assures good heat transfer between the fulcrum plate 50 and mounting plate 60.

Figure 4:
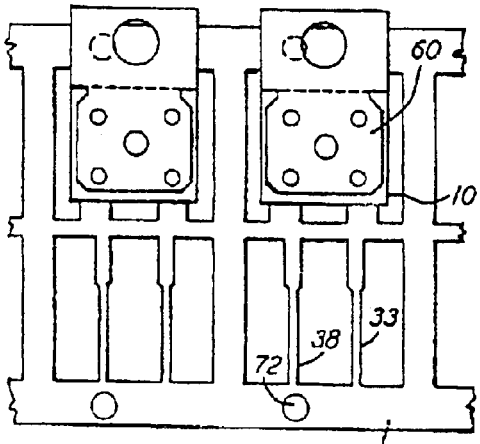
FIG. 4 Prior Art
FIG. 4 is a plan view of the thermostat in strip form according to the prior art.

Referring particularly to FIG. 4, the manufacture of the switch can be understood. The terminal pins 33, 38 are part of a stamped metal strip bounded by carrier strips 70 having indexing holes 72 which facilitate indexing through the various work stations. The strip is first fed through a molding station where the housing is molded thereon, then proceeds through various stations where the parts are assembled as previously described to yield the assembly shown. The individual thermostats are then sheared from the carriers and packaged in tubes or the like for use by the customer.

EXAMPLE

Figure 5:
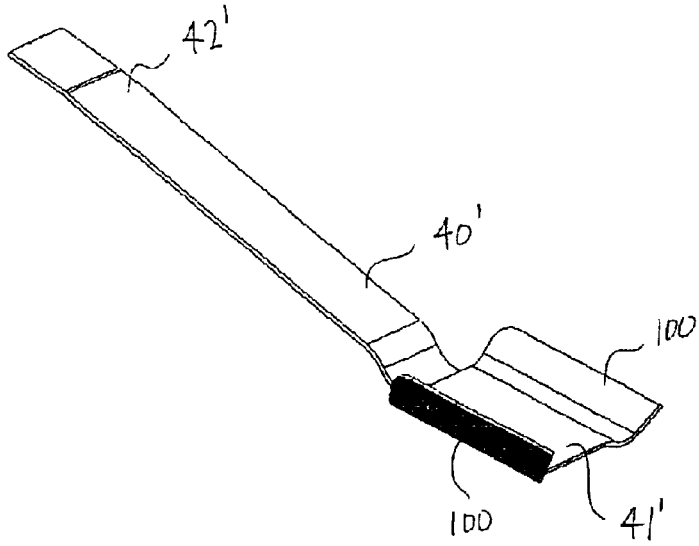
FIG. 5 is a perspective view of a contact spring according to the present invention.

A thermostat switch is provided generally as set forth in the Comparative Example, with the exception that the base 41 of the arm 40 as shown therein is replaced with an arm 40' with a base 41' having a pair of lateral formed tabs extending from the base 41', directed in the same direction as the bent free end 42', as shown in FIG. 5. These tabs extend about 0.020" from the plane of the base 41', with a bending radius of about 0.008", extending outward at an angle of about 65°. The free end extends at an angle of about 12°.

Figure 6:
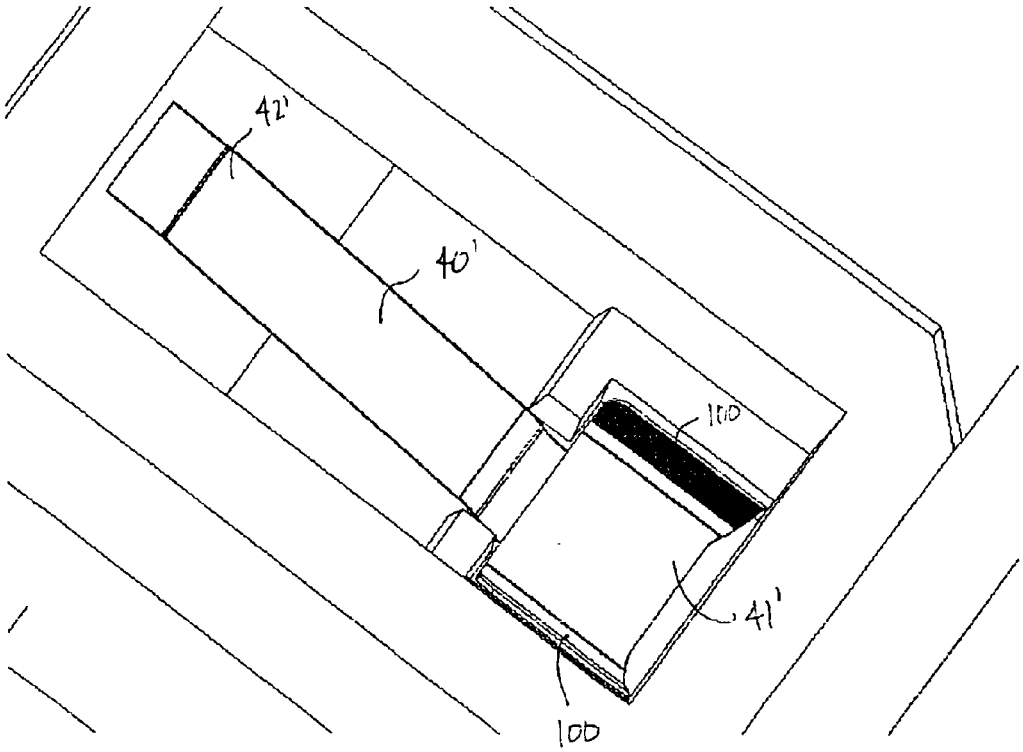
FIGS. 6 and 7 show, respectively, a perspective and top view of the contact arm properly situated within the housing according to the present invention.
Figure 7:
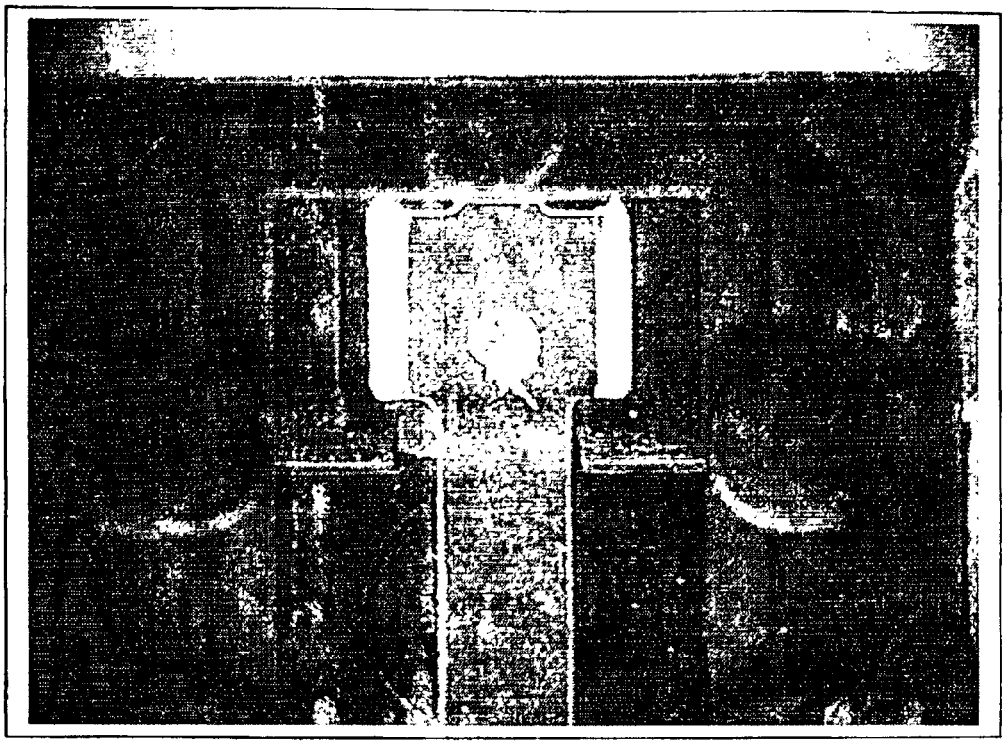

The cavity of the preferred embodiment differs from the cavity of the switch described in the Comparative example in that the locating portions 28 do not have ribs 29. Therefore, the locating portion 28 walls are smooth. During assembly, the arm 40' is inserted, tabs 100 and free end 42' facing out of the cavity formed by portions 28 and floor 12, by a pick-and-place apparatus. FIGS. 6 and 7 show, respectively, a perspective and top view of a correctly placed contact arm 40'.

A pilot run produced samples that uniformly showed good placement and alignment (No bent spring). It is noted that spring arms 40' should be similar in length and arm angle to spring arms 40 in order to be properly processed on the same equipment; and any such variations may cause quality issues.

Figure 8:
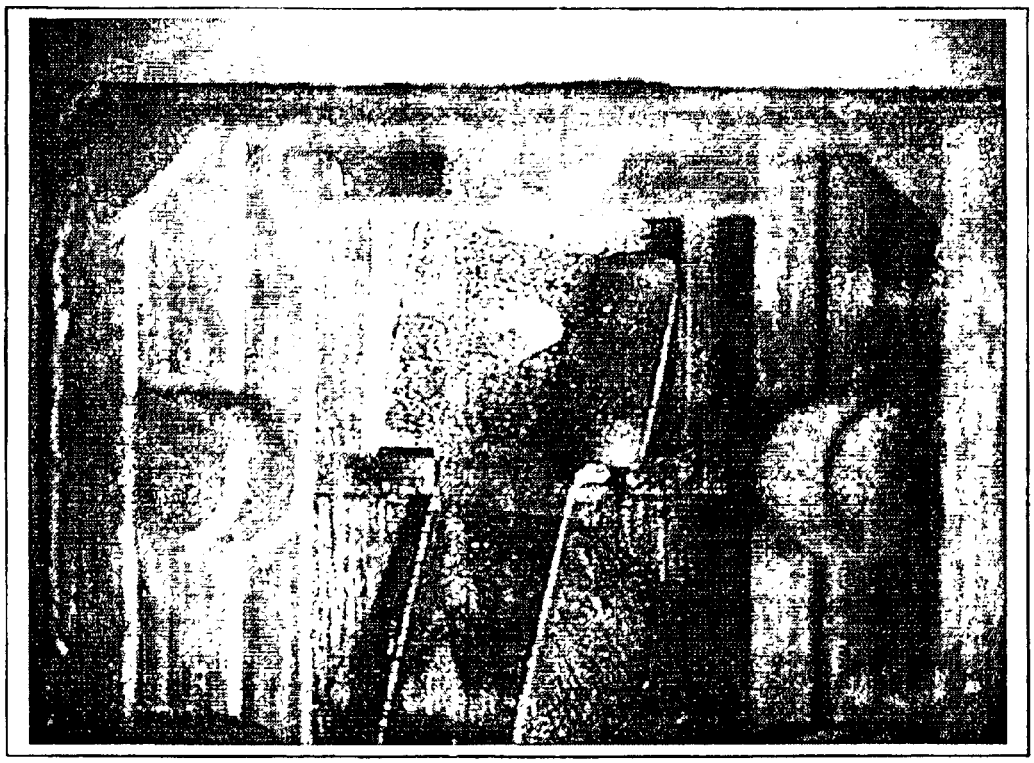
FIG. 8 shows a failure mode resulting from a misaligned contact arm according to the prior art.
Figure 9A:
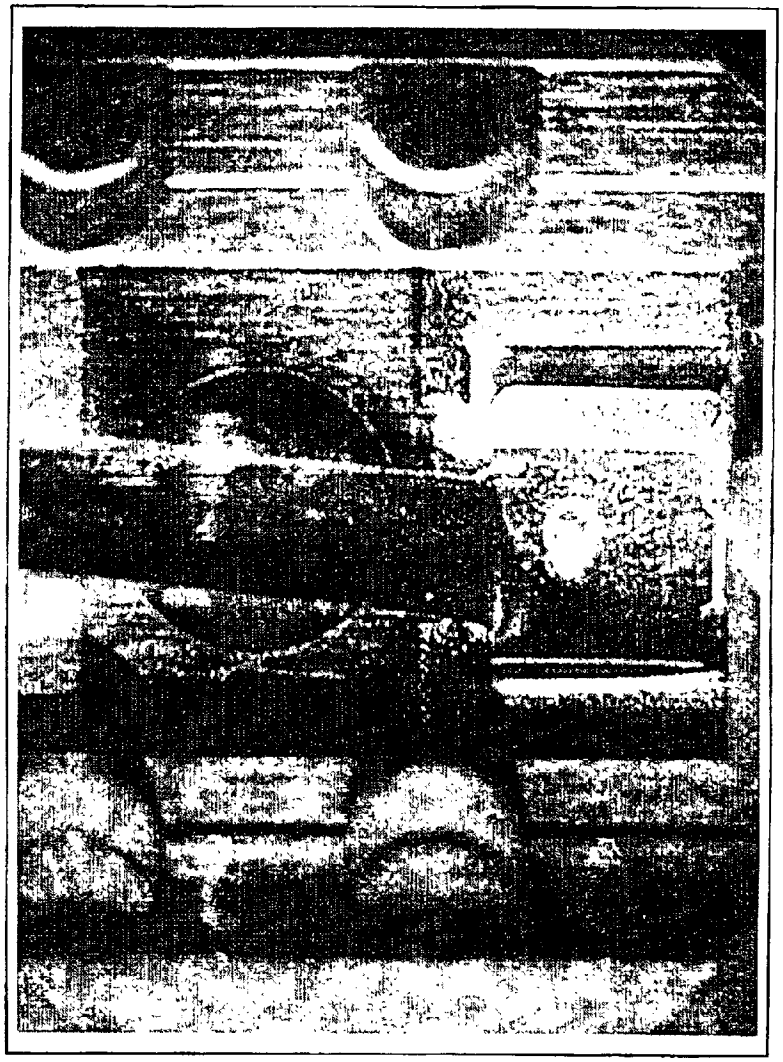
FIGS. 9A, 9B and 9C show various failure modes according to the present invention.
Figure 9B:
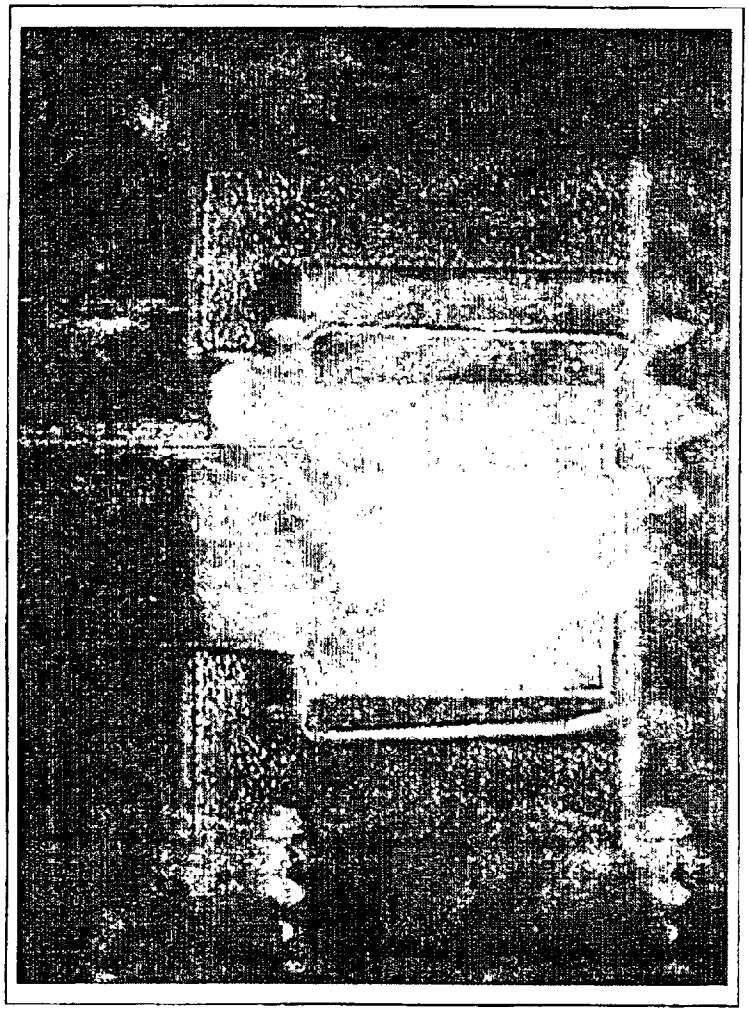
Figure 9C:
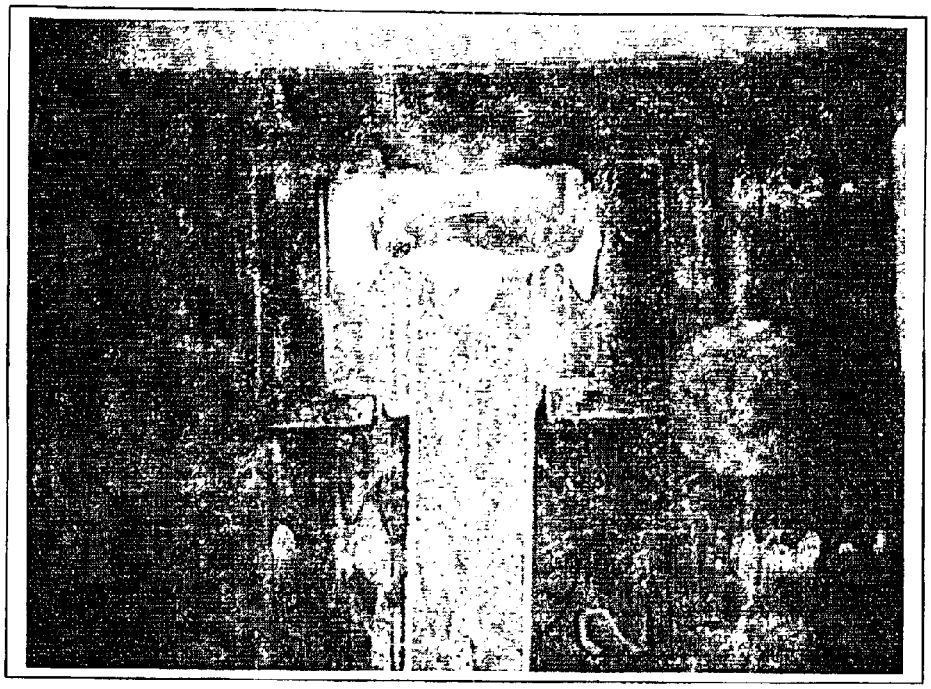

An analysis of the pilot run showed that, near the end of the run, 2.25–3% of spring arms 40' were misaligned, (See FIGS. 9A, 9B and 9C) while 7.1–12.74% of a production run according to the Comparative Example (absent ribs 29 and corresponding notches on arm 40) were considered defective (See FIG. 8). After completion of assembly, functional yield was 95% according to the present invention, as compared to about 93.9% for the Comparative Example.

Failure mode analysis indicated that, through higher quality control on the spring free end 42' angle to achieve a nominal 12°, elimination of the cutoff tab on the base 41, and optimization of the spacing between the lateral tabs 100, a scrap rate of the design according to the present invention at the assembly station would near 0%, with statistical functional performance also likely improved. On the other hand, no reasonable known remedies were available defect modes for the manufacturing process according to the Comparative Example.

Analyzing the miss-assembled arms according to the present invention, two failure modes were detected. First, the free end 42' of the contact arm 40' hand a tendency for hanging up on the front wall of the cavity. Second, the base 41' had a tendency for hanging up on the back edge of the case. The possible factors for causing these failure modes are: Base miss-alignment (as molded); miss-alignment in the pick and place station; the presence of the cut-off tab on the pad, which negated the lead-in function of the form angles in the back; and picking and placing the arm at an angle, possibly due to the buckling of the spring tape, caused by the sprocket gears going out of sink. Each of these causes is remediable by obvious and generally known means, and thus such known means are complementary to the present invention. The assembly operations are preferably automated, with an automated pick and place system.

A low temperature shift functional failure mode, as well as the observed mechanical defects, may be explained by a spring arm 40' having a greater than nominal height (>12°). This increase in height causes an increase in the disc opposing force, hence shifting the temperature. The high arm also causes the disc to set high up, beyond the edges of the base, hence causing cap assembly failures and pinched disc. This, in turn, leads to "No operation" and increased Hi-Pot failures. Therefore, by achieving a consistent angle on the spring arm 40', which may be obtained according to known methods, failures attributable to this tolerance factor may be eliminated. In addition, it is noted that, during the pilot run, the sample reel was handled a second time during manual forming of the contact pads, which could have created more variations. The form angles of the tabs 100 may also be widened or otherwise optimized in order to form a closer fit to help the spring arm 40' self orient and align closer to the center in the pocket. Clearly, the cutoff tab for the spring arm 40' may be eliminated to avoid any interference therefrom. In addition to adjusting the spring arm free end 42' length, the extension of the front walls of the pad cavity may be minimized to provide increased clearance, or otherwise optimized.

The foregoing is exemplary and not intended to limit the scope of the claims which follow.

What is claimed:

1. A switch comprising a molded housing having a cavity, and a set of electrical terminals formed within said cavity, with a displaceable elongated contact arm selectively forming a circuit between said set of terminals, wherein said displaceable elongated contact arm comprises a base having a formed edge which mates with said molded housing inside said cavity, to align said displaceable elongated contact arm with respect to said set of terminals, said formed edge being provided on a first portion of said base displaced out of a plane defined by a second portion of said base.

2. The switch according to claim 1, wherein said housing is a standard dual inline pin type package.

3. The switch according to claim 1, wherein said housing is a standard TO-220 type package.

4. The switch according to claim 1, wherein said displaceable elongated contact arm forms a fixed contact with one of said set of electrical terminals and a variable contact with respect to another of said set of terminals.

5. The switch according to claim 1, wherein said displaceable elongated contact arm is displaced by a bimetal element, forming a thermostat.

6. The switch according to claim 1, wherein said displaceable elongated contact arm is formed on a reel having a plurality of displaceable elongated contact arms in parallel.

7. The switch according to claim 1, wherein said displaceable elongated contact arm is formed on a reel having a plurality of displaceable elongated contact arms in parallel, and wherein a said displaceable elongated contact arm does not have a residual cutoff tab.

8. The switch according to claim 1, wherein said displaceable elongated contact arm has a nominal flexion angle to displace said arm from a plane of said second portion of said base, wherein said formed edge of said base defines an axis which extends in a same direction as said displaceable elongated contact arm.

9. The switch according to claim 1, wherein said formed edge of said base comprises a pair of lateral bent edges adapted for engaging respective lateral sidewalls of said cavity.

10. The switch according to claim 1, wherein said formed edge of said base comprises a pair of lateral bent edges adapted for engaging respective lateral sidewalls of said cavity, wherein a force of said respective lateral sidewalls compresses said bent edges, to provide an alignment force for said displaceable elongated contact arm.

11. The switch according to claim 1, wherein said formed edge of said base comprises a pair of lateral formed appendages supporting said formed edge at a end thereof distal with respect to said base, adapted for engaging respective lateral sidewalls of said cavity, said lateral formed appendages being spaced such that said respective lateral sidewalls compress said lateral formed appendages.

12. In a thermostatic switch for mounting to a circuit board, having:

a molded dielectric housing of boxlike shape having a cavity bounded by a floor, opposed parallel endwalls, and opposed parallel sidewalls, first and second terminals having inner parts disposed inside said housing in said floor toward respective endwalls, the inner part of said second terminal having a fixed contact thereon, each said terminal having an external mounting pin, said inner parts connecting to said pins through one of said sidewalls.

an elongate contact arm having a first end fixed to the inner part of said first terminal and an opposed second end biased away from the inner part of said second terminal but movable theretoward, said second end having a movable contact fixed thereto, a fulcrum having a fulcrum point disposed between said sidewalls and said endwalls, a hysteretic thermal sensing element arranged between said fulcrum and said contact arm, so that in one stable position the movable contact is against said fixed contact and in the other stable position the movable contact is displaced from said fixed contact, the improvement comprising:

a pair of laterally opposed locating walls having a recess therebetween; and a pair of bent tabs on said elongate contact arm, configured to form fit with said locating walls, wherein said locating walls and bent tabs cooperate to align the elongate contact arm along its elongate axis during insertion in said recess.

13. A thermostatic switch as in claim 12 wherein said housing is molded onto said terminals.

14. A method for forming a switch, comprising the steps of providing a molded housing having interior sidewalls defining a cavity, and a set of electrical terminals formed within the cavity; inserting a displaceable elongated contact arm within the cavity, the displaceable elongated contact arm having a base having a plane with formed edges displaced from said plane which mate with the sidewalls, to align the displaceable elongated contact arm with respect to the set of terminals.

15. The method according to claim 14, further comprising the step of forming, with the displaceable elongated contact arm, a fixed contact with one of the set of electrical terminals and a variable contact with respect to another of the set of terminals.

16. The method according to claim 15, further comprising the step of displacing the displaceable elongated contact arm with a bimetal element.

17. The method according to claim 15, further comprising the step of welding the displaceable elongated contact arm to form the fixed contact with one of the set of electrical terminals.

18. The method according to claim 14, wherein the displaceable elongated contact arm is formed on a reel having a plurality of displaceable elongated contact arms in parallel, further comprising the step of eliminating a residual cutoff tab from the displaceable elongated contact arm.

19. The method according of claim 14, wherein the formed edges comprises a pair of lateral bent edges adapted for engaging the sidewalls of the cavity laterally, wherein a force of the respective lateral sidewalls compresses the bent edges, to provide an alignment force for the displaceable elongated contact arm.

20. The method according to claim 14, wherein the displaceable elongated contact arm is inserted in the cavity with an automated pick and place system.

* * * * *